United States Patent [19]

Ekowicki et al.

[11] Patent Number: 4,823,104

[45] Date of Patent: Apr. 18, 1989

[54] CONTROLLED CYCLING THERMAL PROTECTOR

[75] Inventors: Robert Ekowicki, Westbrook; Richard C. Watson, Sebago Lake, both of Me.

[73] Assignee: GTE Products Corporation, Stamford, Conn.

[21] Appl. No.: 219,116

[22] Filed: Jul. 15, 1988

[51] Int. Cl.[4] ..... H01H 61/02; H01H 71/16

[52] U.S. Cl. ..... 337/102; 337/107; 361/105

[58] Field of Search ..... 337/102, 103, 104, 105, 337/106, 107; 219/505, 511; 361/105, 106

[56] References Cited

U.S. PATENT DOCUMENTS 3,272,944 9/1966 Ricker et al. ..... 337/107

4,287,500 9/1981 Ueda ..... 337/107

*Primary Examiner*—H. Broome

*Attorney, Agent, or Firm*—James Theodosopoulos

[57] ABSTRACT

A controlled cycling thermal protector device is provided comprising a snap blade and a PTC resistive heater disposed outside of a bulbous envelope in which the snap blade thermal protector is housed. The snap blade thermal protector and the resistive PTC heater are wired and constructed so as to prevent cycling of the snap blade thermal protector. The PTC heater is disposed upon a sleeve which encircles the bulbous envelope so as to radiate heat onto the snap blade thermal protector to keep it open once the circuit has been broken.

6 Claims, 1 Drawing Sheet

CONTROLLED CYCLING THERMAL PROTECTOR

BACKGROUND OF THE INVENTION

The present invention relates to thermal protectors and more particularly to thermal protectors having at least one thermally responsive bimetal blade which is designed to be reset after opening by removing an impressed voltage, thereby allowing the blade to cool and close.

Generally, thermal protectors of the type described herein have a stationary electrode and a movable electrode. The movable electrode is responsive to heat and generally takes the form of a bimetal blade. When the ambient temperature rises to a predetermined level, the movable electrode distances itself from the stationary electrode and interrupts the current to the load that is being protected. The load is connected to a power source through the thermal protector. These types of safety devices are generally used to prevent overheating of various types of electrical machinery, equipment and circuits.

Of the bimetal thermal protectors, resetable types have been disclosed where the movable electrodes are bridged with a heat sensitive resistor, generally in a manner such that the resistor is inserted into a recess in the movable electrode or is disposed around lead-in wires that extend within the envelope. An example of the latter type of protector is shown in the U.S. Pat. No. 4,287,500 to Ueda, which discloses the use of a PTC heater inside of a bulbous envelope to keep a bimetal blade open after it has opened initially. The bimetal blade stays open until the entire protector is removed from the circuit and/or the current to the load is terminated.

SUMMARY OF THE INVENTION

The present invention relates to a thermal protector in which a pair of electrodes are disposed within a sealed bulbous envelope. One the electrodes is movable and the other is stationary. The movable electrode is a bimetal blade and is responsive to ambient temperatures. It will snap open when the ambient temperature exceeds a predetermined level whereby to break the circuit. Such changes in temperature are usually caused by a short circuit in one of the components being protected or by a transient voltage spike, as will be explained hereinafter.

According to the present invention, a PTC heater is disposed on the outside of the envelope in a heat-transmitting relationship with the bimetal blade disposed therein. In the preferred embodiment, the PTC heater is disposed upon and attached to a thermally and electrically conductive sleeve which encircles the bulbous portion of the glass envelope that houses the bimetal blade. When a transient voltage spike occurs, such as might happen when lightening strikes a power line, heat is produced within the protector and the movable electrode snaps open whereby to protect the circuit or equipment that it guards. Also, if there is a short circuit in the equipment being protected, the ambient heat in the envelope will increase whereby to snap open the bimetal blade.

The PTC heater that is disposed outside of the envelope is wired in parallel across the electrodes which are disposed inside of the envelope. It remains in an idle state until the movable bimetal blade opens. When the bimetal blade opens because of surges or fault conditions, the voltage and current are dropped across the PTC heater. Because the PTC heater increases in resistance as it heats up, current load on the protected equipment is lowered from amps to milliamps thereby causing the PTC heater to rise in temperature to a predetermined level.

Through the design of the present controlled cycling thermal protector, the trip and reset temperatures of the bimetal blade in the device, and the switch temperature of the PTC heater, we have discovered a breaker which controls the cycling of the protector. The protection afforded by our device is quite different than that which has been disclosed in the prior art because although thermal protectors may open at a given predetermined temperature range, they do not usually shut down completely. After a period of time following the opening of the bimetal blade, and if there is no current load, the protector will cool and reclose. The reclosing will present an opportunity for the protector to open again and repeat the cycle. This cycling mode can damage the circuit or equipment that is being protected. Moreover, by disposing the PTC heater outside of the envelope, the protector is more reliable and easier to manufacture. The problems associated with assembly of the device, outgassing of the PTC, and failure of the protector are minimized.

DESCRIPTION OF THE PREFERRED EMBODIMENT

Figure 1:
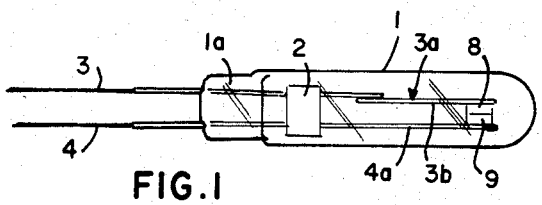
FIG. 1 is a side perspective view of a bimetal switch disposed within a bulbous envelope which can be used in the thermal protector of the present invention.

Referring now to FIG. 1, a thermal protector in accordance with the present invention is shown having a bulbous glass envelope 1 which is sealed together in a press seal area 1*a* using conventional techniques. The glass envelope 1 is conventionally filled with dry air. A pair of lead-in wires 3 and 4 extends through the press seal area 1*a* into the interior of a bulbous envelope 1. A glass pad 2 serves to maintain a stationary electrode 4*a* and a movable electrode 3*a* in a predetermined, spaced apart relationship within the envelope 1 so as to provide for electrical insulation within the protector.

The movable electrode 3*a* comprises a bimetal blade 3*b* which is welded to lead-in wire 3 at the end thereof. The bimetal blade 3*b* is set to open upon reaching a predetermined temperature in the range of 140° to 160° C. Electrical contacts 8 and 9 are welded to the leading end of the stationary electrode 4*a* and the leading end of the bimetal blade 3*b*. Such electrical contacts are conventionally formed of silver or with silver coatings.

Figure 2:
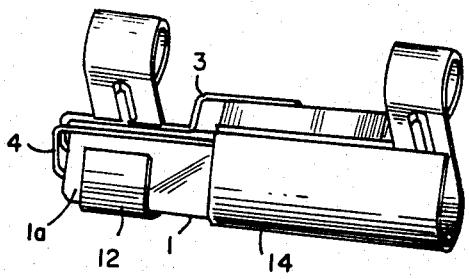
FIG. 2 is a perspective view of one side of a thermal protector using the bimetal switch shown in FIG. 1.
Figure 3:
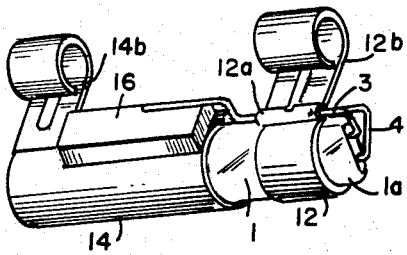
FIG. 3 is a side perspective view of the protector device according to the present invention showing the other side of the device illustrated in FIG. 2.

Referring now to FIGS. 2 and 3, the bulbous envelope 1 is shown with the PTC heater and electrical connection devices. A first sleeve 14 is snapped around the bulbous portion of the envelope 1 and is disposed adjacent to the press seal area 1*a*. The first sleeve 14 can be made of any conventional electrically conductive material of sufficient resiliency to enable it to firmly grasp the envelope 1. Such metals include copper and nickel plate copper. A second sleeve 12 is disposed about the bulbous portion of the envelope 1 and in a heat-transmitting relationship therewith. Preferably, the radius of the first sleeve 14 is substantially identical to that of the bulbous portion of the envelope 1. Preferably, also, the first sleeve 14 covers substantially all of the bulbous portion of the envelope 1. The first sleeve 14 is spaced from the second sleeve 12 so as to provide electrical insulation between them.

Lead-in wire 4 is bent over the press seal area 1*a* and bulbous portion of the envelope 1 and is welded to the first sleeve 12 (not shown) to provide an electrical connection. Lead-in wire 4 is electrically insulated from the second sleeve 12 and by-passes it as shown in FIG. 2. The second sleeve 12 has a bridge 12*a* extending across its width to receive the lead-in wire 3.

Lead-in wire 3 is also bent around the press seal area 1*a* of the glass envelope 1. It is welded to the second sleeve 12 at the bridge 12*a*, also to provide an electrical connection. The lead-in wire 3 extends along the bulbous portion 1 for a short distance.

A conventional PTC heater 16 having an operating temperature in the range of 175° to 180° C. (but above the temperature which would enable the bimetal blade to snap closed and reestablish the circuit) is welded to the first sleeve 14 to provide the protection against cycling of the movable blade 8 of the thermal protector that is disposed in the bulbous envelope 1, as will described hereinafter.

PTC heaters are well known in the art. Such heaters can be made in a flat shape and are formed, generally, of doped barium titanate ceramics which have a sharp positive temperature coefficient of resistance. The PTC ceramics are designed such that below a critical voltage, the resistance of the ceramic remains at an essentially constant value. When a particular voltage is impressed upon the PTC ceramic, a crystalline phase change takes place in the ceramic and this abrupt change in crystal structure is accompanied by a sharp increase in the resistance of the crystalline grain boundaries. The result of this crystalline change is an increase in the heater resistance of several orders of magnitude over a very small temperature range. The barium titanate heater with a room temperature resistance of 3.0 ohms will to 1,000 ohms or more during the crystalline phase change. The voltage at which the crystalline phase change takes place can be adjusted in the PTC heater manufacturing process through the use of appropriate chemical additives. Such voltages can be varied between about 60 and 120 V AC/DC volts.

When energized by a suitable voltage impressed upon it by applying current to opposite sides of the ceramic, the PTC heater rapidly heats up in a predetermined operating temperature and then "locks in" at this temperature. This rapid heating is due to the initial low resistance of the PTC heater which results in an internal high power of the heater. The "lock in" is due to an abrupt increase in resistance which causes generated power to be reduced until it equals dissipated power. At this point, a thermal equilibrium is achieved and the PTC heater self-regulates itself at that temperature, so long as the voltage is impressed upon it.

The PTC heaters that are used in accordance with the present invention include the above mentioned barium titanate ceramic base structure with a metallized coating disposed on either side of the base (not shown). The metallized coatings are electrically insulated from each other so as to provide the resistance such as described herein.

In the present invention, one of the coatings is welded onto the first sleeve 14. Electrical connections are made between the lead-in wire 3 that is welded to one side of the PTC heater 16 and the second sleeve 14 so that upon the imposition of a predetermined voltage, the PTC ceramic will heat up. Electrical connections are provided with the extension arms 12*b* and 14*b* which extend outwardly from the first sleeve 14 and the second sleeve 12, respectively.

In the preferred embodiment, the arms 12*b* and 14*b* extend outwardly from the radius of the sleeves 12 an-d 14 and are formed with electrical connections at the ends thereof. Preferably, these electrical connections are cylindrical so as to enable the user of the device to slip them easily on to studs.

As can be appreciated, the PTC heater 16 is electrically connected in parallel with the bimetal blade 8 disposed within the bulbous envelope 1. Under normal conditions, the current will flow between arm 14*b* through lead-in wire 4 through the closed bimetal blade and the stationary electrode and out through arm 12*b*. When the bimetal blade opens, the PTC heater will be energized and will heat the second sleeve 14 to keep the PTC heater open. The heat generated by the PTC heater is above that which will actuate the bimetal blade whereby the electrical circuit between the electrodes of the thermal protector will remain open until such time as the thermal protector can be removed from the circuit.

In the preferred embodiment, the bimetal blade has a design opening temperature of 150° C. and a design closing temperature of 120° C. The PTC heater had a anomoly temperature of 25° C. When the contact was opened, when the environmental temperature reached 177° C., both contacts remained opened by constant temperature heating of the envelope so long as the voltage was impressed upon both contacts. When the device was removed from the circuit, the bimetal blade closed after the PTC heater was turned off.

Figure 4:
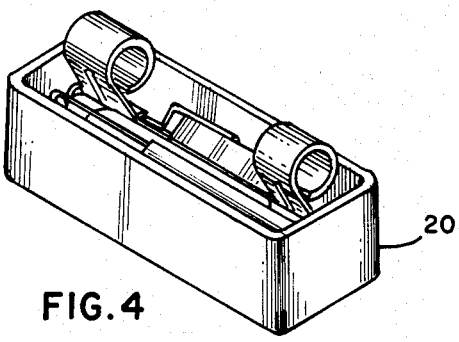
FIG. 4 is a perspective view of the thermal protector disposed in a protective case.

As shown in FIG. 4, the protector device described in FIGS. 2 and 3 can be easily fitted into a protective cover 20. Preferably, the protective cover is in the shape of a rectangle so that it can be easily grasped with the fingers to remove and replace it when the circuit is broken.

It is apparent that modifications and changes can be made within the spirit and scope of the present invention, but it is our intention, however, only to be limited by the scope of the appended claims.

As our invention, we claim:

1. A protective device comprising:

a thermally conductive sealed envelope and a pair of electrodes disposed therein, one of said electrodes being stationary and the other being movable, said movable electrode having a heat responsive element, said electrodes further being disposed in an opposed relationship to each other whereby to open the contact between said electrodes when a predetermined temperature level is reached; and a PTC heater comprising a ceramic body and a pair of electrodes disposed on each side of said body, said PTC heater being disposed external of said sealed envelope and in a heat-transmitting relationship therewith; and a pair of electrical contact means attached to the exterior of said envelope; and means connecting each of said contact means to each of said lead-in wires, and connecting each side of said PTC heater in parallel with said electrodes.

2. The protection device according to claim 1 wherein the contact means comprises sleeves that are disposed about said envelope.

3. The protection device according to claim 2 wherein said PTC heater is attached to one of said sleeves whereby to transmit heat thereto and to the interior of said envelope.

4. The protection device according to claim 1 wherein the envelope contains a bulbous portion and a seal portion, and at least one of said sleeves being disposed about said bulbous portion and the other said sleeves is disposed about said seal portion, said PTC heater being attached to the sleeve that is disposed about said bulbous portion whereby to transmit heat form said PTC heater to the electrodes disposed in said bulbous portion.

5. The protection device according to claim 1 wherein each of said electrical contact means further include arms which extend from said sleeves whereby to provide electrical contact with an external source.

6. The protection device according to claim 5 further including a case disposed about said sealed envelope and said sleeves.

* * * * *